US009145686B2

(12) United States Patent
Fooks

(10) Patent No.: US 9,145,686 B2
(45) Date of Patent: Sep. 29, 2015

(54) SKYLIGHT DOME

(71) Applicant: Rodric Lindsay Fooks, Riverstone NSW (AU)

(72) Inventor: Rodric Lindsay Fooks, Riverstone NSW (AU)

( * ) Notice: Subject to any disclaimer, the term of this patent is extended or adjusted under 35 U.S.C. 154(b) by 0 days.

(21) Appl. No.: 13/910,728

(22) Filed: Jun. 5, 2013

(65) Prior Publication Data

US 2013/0333312 A1 Dec. 19, 2013

(30) Foreign Application Priority Data

Jun. 5, 2012 (AU) ..... 2012203297

(51) Int. Cl.
*E04D 13/03* (2006.01)

(52) U.S. Cl.
CPC ..... *E04D 13/0315* (2013.01); *E04D 13/033* (2013.01); *E04D 2013/0345* (2013.01)

(58) Field of Classification Search
CPC ..... E04D 13/033; E04D 2013/0345; F21S 11/00; F21V 7/0091; G02B 3/08
USPC ..... 52/200; 362/335, 337, 338, 339, 340, 362/145, 147; 359/591, 592, 598, 743
See application file for complete search history.

(56) References Cited

U.S. PATENT DOCUMENTS

| | | | | |
|---|---|---|---|---|
| 3,350,556 | A * | 10/1967 | Franck et al. | 362/309 |
| 5,655,339 | A * | 8/1997 | DeBlock et al. | 52/200 |
| 5,983,581 | A * | 11/1999 | DeBlock et al. | 52/200 |
| 7,322,156 | B1 * | 1/2008 | Rillie et al. | 52/200 |
| 7,546,709 | B2 * | 6/2009 | Jaster et al. | 52/200 |
| 8,132,375 | B2 * | 3/2012 | Jaster | 52/200 |
| 2007/0074468 | A1 | 4/2007 | Jaster et al. | |

FOREIGN PATENT DOCUMENTS

| | | |
|---|---|---|
| GB | 2384022 A | 7/2003 |
| WO | 2010/151369 | 12/2010 |

* cited by examiner

*Primary Examiner* — Jeanette E Chapman
*Assistant Examiner* — Daniel Kenny
(74) *Attorney, Agent, or Firm* — Ladas & Parry LLP

(57) ABSTRACT

A dome for a skylight; said dome formed of light transmitting material; at least an internal surface of said dome provided with prismatic structures arranged so as to direct incident light from without said dome to points below a lower periphery of said dome; said prismatic structures formed as adjoining facets of a plurality of curved ridges; each of said curved ridges extending from a first upper end to a second lower end.

18 Claims, 3 Drawing Sheets

SKYLIGHT DOME

TECHNICAL FIELD

The present invention relates to natural lighting of buildings and, more particularly, to roof mounted skylights adapted to transmit light into the interior of a building.

BACKGROUND

Skylights have traditionally been formed as structures similar to windows, comprising a frame with sheet glazing to admit light through an aperture in a roof surface.

More recently a form of skylight, shown schematically in FIG. 1, which has gained wide acceptance, includes a transparent dome installed above an aperture in the roof surface. A cylindrical, so-called light tube, extends from below the lower periphery of the dome, through the roof aperture and down to the ceiling. The interior surface of this cylindrical light tube is highly reflective so as to reflect angled light entering the dome down to a diffuser at the lower end of the tube, generally at ceiling level.

Although these dome and light tube skylights are effective, the dome, being of a simple, generally constant wall thickness, has little effect on the direction of incident light passing through the dome and entering the light tube.

An improvement in the light gathering ability of a skylight dome was disclosed in U.S. Pat. No. 7,546,709 in which the interior surface of the dome is provided with an arrangement of refracting elements, somewhat in the manner of a Fresnel lens. The refracting elements are arranged as continuous circles of ridges parallel to the lower periphery of the dome. Although an advance over plain light admitting domes, the particular arrangement of the refractive surfaces is only optimally effective in directing incident rays of sunlight impinging on the dome in regions close to planes passing through the dome's axis and aligned with the direction of the sun. Sunlight striking the dome away from this optimal region is increasingly either largely reflected off the dome surface or not optimally refracted into the light tube.

It is an object of the present invention to address or at least ameliorate some of the above disadvantages.

NOTES

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

The terms "meridian" and "latitude" used in this specification are defined respectively as a line on the surface of the dome of the invention defined by a plane vertical to the lower periphery of the dome and passing through its apex, and a circle on the dome parallel to the lower periphery of the dome.

SUMMARY OF INVENTION

Accordingly, in a first broad form of the invention, there is provided a dome for a skylight; said dome formed of light transmitting material; at least an internal surface of said dome provided with prismatic structures arranged so as to direct incident light from without said dome to points below a lower periphery of said dome; said prismatic structures formed as adjoining facets of a plurality of curved ridges; each of said curved ridges extending from a first upper end to a second lower end.

Preferably, each of said curved ridges extends between a first meridian of said dome at said first upper end and a second meridian of said dome at said second lower end.

Preferably, said first and second meridians have an angular separation of less than 180 degrees.

Preferably, said first and second meridians have an angular separation of less than 90 degrees.

Preferably, at least one of said adjoining facets of each of said curved ridges is a refracting facet; a surface of said refracting facet at any point along the length of said curved ridge forming a predetermined angle relative an internal surface of said dome at said point.

Preferably, said predetermined angle varies throughout the length of a said curved ridge from a maximum value at said first upper end of a said curved ridge to a minimum value at said second lower end of said curved ridge.

Preferably, width of said refracting facet increases from a minimum at said first upper end of said curved ridge to a maximum at said second lower end of said curved ridge.

Preferably, said curved ridges are formed in at least two bands of curved ridges; each of said at least two bands lying between notional circles parallel to said lower periphery of said dome.

Preferably, said internal surface of said dome in a region bounded by an uppermost one of said notional circles is devoid of said curved ridges.

Preferably, said internal surface of said dome in a region between said at least two bands of curved ridges is devoid of said curved ridges.

Preferably, at least said outer surface of said dome is a generally hemispherical surface.

Preferably, portions of said outer surface of said dome coincident with each of said at least two bands of curved ridges form frustum surfaces between said notional circles defining said at least two bands of curved ridges.

Preferably, said dome is a component of a skylight assembly; said skylight assembly including a reflective cylindrical light tube extending from below said lower periphery of said dome.

In another broad form of the invention, there is provided a method of directing incident light falling on a skylight dome towards points below a lower periphery of said dome, said method including the steps of:

(a) providing at least portions of an internal surface of said dome with light refracting structures, (b) arranging said light reflecting structures as curved ridges extending from a first upper end to a second lower end and between a first meridian of said dome at said first upper end and a second meridian of said dome at said second lower end.

Preferably, each of said curved ridges is formed as adjacent facets; at least one of said adjacent facets acting as a refracting facet.

Preferably, said method further includes the step of arranging said curved ridges in at least two bands of curved ridges; said bands of curved ridges lying between notional circles parallel to said lower periphery of said dome.

Preferably, at least a first region proximate the apex of said dome is devoid of said curved ridges.

Preferably, said first and second meridians of said dome for each of said curved ridges lie at a predetermined angular separation.

Preferably, said predetermined angular separation is less than 180 degrees.

Preferably, said predetermined angular separation is less than 90 degrees.

Preferably, at least portions of said incident light refracted by said refracting facets are incident on a wall of a reflective cylindrical tube extending from below said lower periphery of said dome.

BRIEF DESCRIPTION OF DRAWINGS

Embodiments of the present invention will now be described with reference to the accompanying drawings wherein.

DESCRIPTION OF EMBODIMENTS

Figure 1:
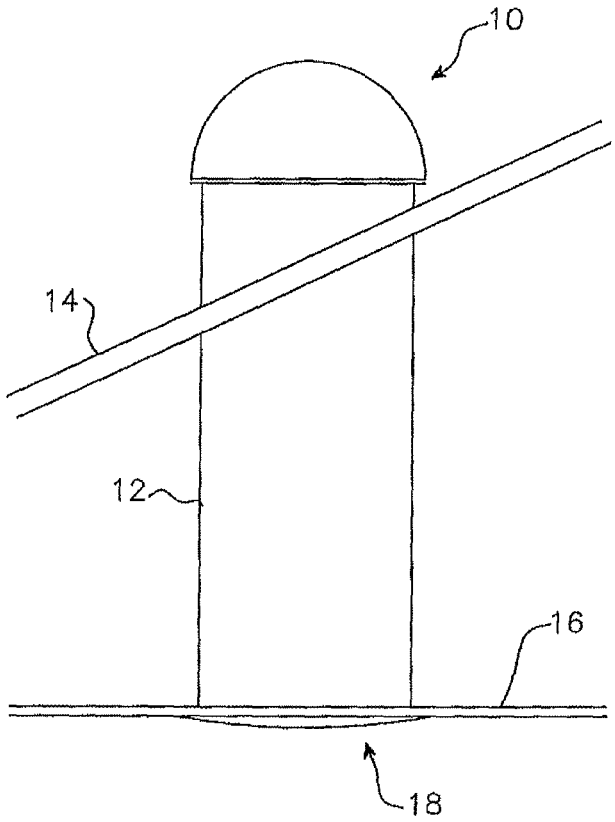
FIG. 1 is a schematic cross section of a typical installation of a skylight dome and light tube assembly.
Figure 2:
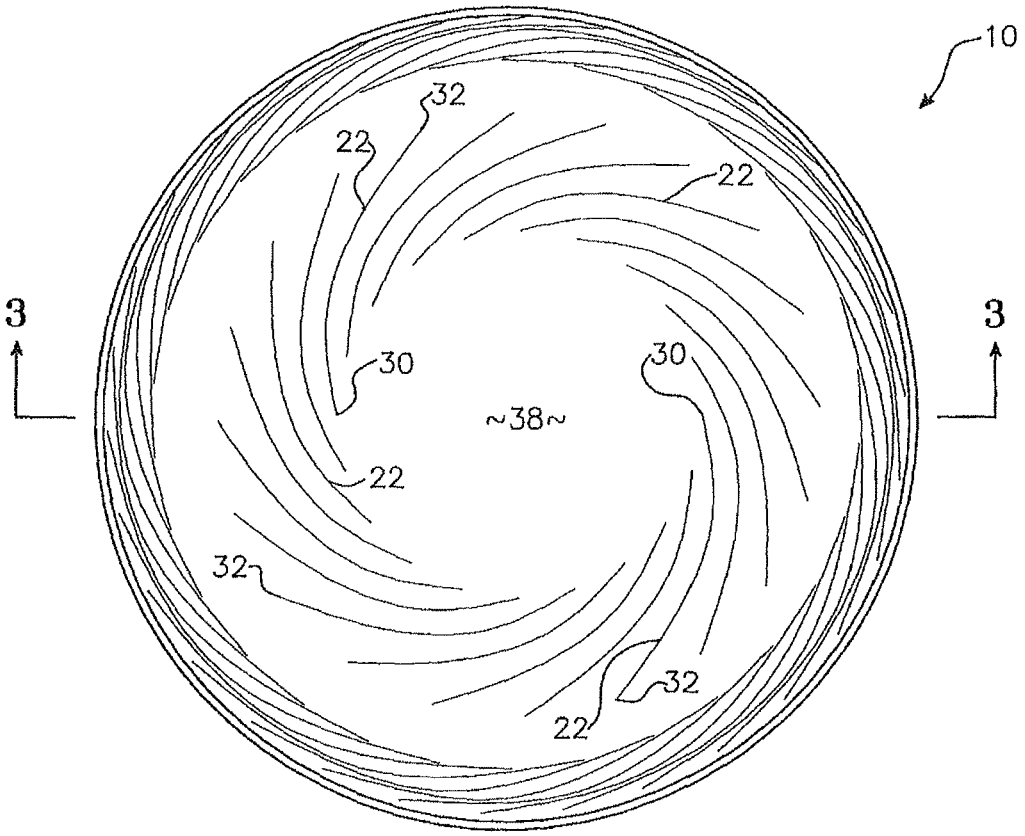
FIG. 2 is a view from below of a skylight dome according to a preferred embodiment of the invention.
Figure 3:
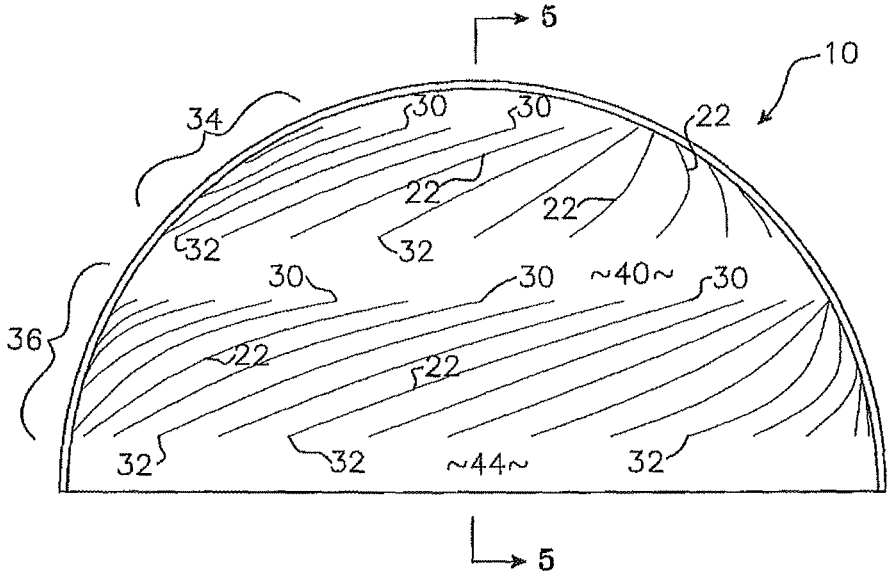
FIG. 3 is a sectioned side view of the skylight dome of FIG. 2.

In a first preferred embodiment of a skylight dome according to the invention, the dome is formed as a generally hemispherical shell in a light transmitting material, such as for example polycarbonate. Similar to the installation shown in FIG. 1, the dome 10 of the invention is conventionally surmounted on a reflective light transmitting light tube 12 which extends through a roof 14 and down to a ceiling 16 and light diffuser 18, as well known in the art.

With reference now to FIGS. 2 to 5, at least the internal surface 20 of the dome 10 is provided with regions of light refracting prismatic structures 22 (represented by single lines only in FIGS. 2 and 3) projecting from the internal surface 20. These structures 22 comprise a plurality of curved ridges 24 formed of adjoining facets 26 and 28. Each of these curved ridges 24 extends from a first upper end 30 to a second lower end 32 and lies between a notional first meridian of the dome at the first upper end and a second notional meridian of the dome at the second lower end.

Preferably, the angular separation between the first and second meridians of each curved ridge 24 is less than 180 degrees and, more preferably, less than 90 degrees.

Preferably also, the curved ridges 24 are arranged in at least two bands of ridges, a first upper band 34 and a second lower band 36 respectively. Each of the first upper ends 30 and second lower ends 32 of the curved ridges 22 in the respective bands 34 and 36 lie between common notional circles (or parallels of latitude) parallel with the lower periphery 42 of the dome. Thus, a region 38 around the apex of the dome and an intermediate region 40 between the two bands, as well as an annular region 44 between the lower band 36 and the lower periphery 42 of the dome 10, are devoid of curved ridges.

For each of the curved ridges 24 formed as adjacent facets 26 and 28, one of the facets 26 is generally angled upwards towards the apex of the dome and forms the primary refracting facet. The surface of the primary facet 26 forms a predetermined angle relative the internal surface of the dome at any given point along the length of its curved ridge.

Figure 4:
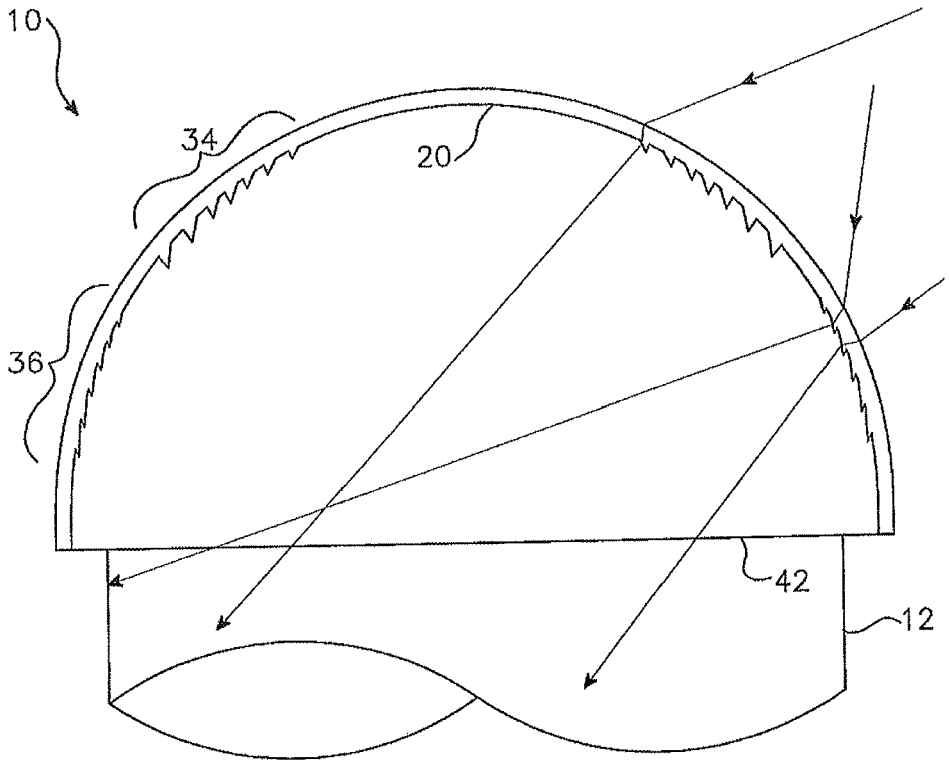
FIG. 4 is a more detailed cross section of the wall of the dome of FIGS. 2 and 3.
Figure 5:
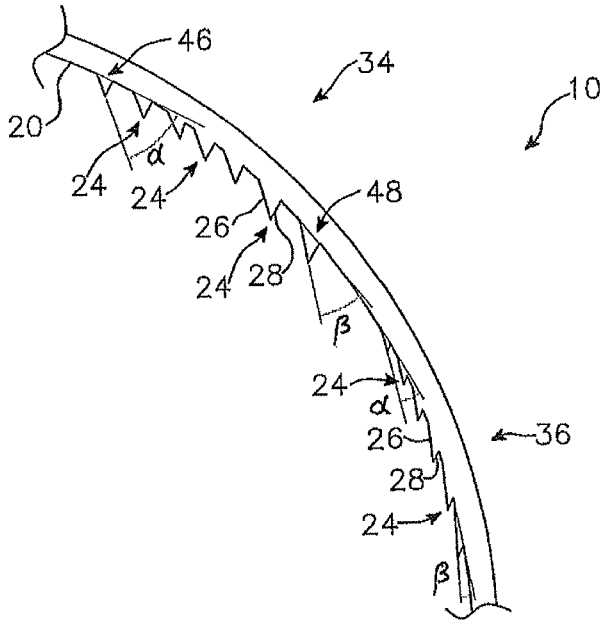
FIG. 5 is an enlarged portion of the wall cross section of FIG. 4.

It can be seen from FIG. 4 and the enlarged cross section of FIG. 5 that, in each of the bands of curved ridges 34 and 36, the primary refracting facets 26 increase in width from a minimum at its first upper end, to a maximum at its second lower end. (It will be understood that in the sectioned view of FIGS. 4 and 5 each successive lower curved ridge has "travelled" further to reach the section plane "5-5" and has thus increased in the width of its primary facet.)

By this means the refractive areas of the primary facets is maximised, with the increasing width filling the increasing spacing between adjoining curved ridges as the diameter of the dome increases and as each ridge passes from its upper end 30 to its lower end 32.

As shown in FIG. 5, as well as increasing in width, the angle of the surface of a primary facet 26 relative to the internal surface 20 of the dome, decreases from a maximum at the first upper end 30 to a minimum at the second lower end 32 of the curved ridge 24. Thus, in FIG. 5, at the uppermost curved ridge 46 of the upper band 34, the angle of the primary facet 24 is a while the lowermost curved ridge 48 of that band, the angle has decreased to β. (Again the effect visible in FIG. 5 is due to the lowermost curved ridge 48 being further advanced at its intersection with the section plane "5-5" than uppermost curved ridge 46.)

It should be understood that the representation of the curved ridges in the accompanying drawings is illustrative only. Thus the preferred disposition of the curved ridges of the invention may lie at much closer spacing so that within each band of ridges, the ridges lie in close proximity to each other. In this respect, the rate at which the width of the primary refractive facet increases may be selected so that the spacing between adjoining ridges is maintained throughout their lengths.

In one preferred embodiment of the invention, the outer surface of the dome 10 coincident with the regions of the two bands of ridges 34 and 36, are flattened so as to form frustums of cones defined by the respective notional circles of latitude parallel to the lower periphery of the dome defining the two bands. In this embodiment, the form of the internal surface within the bands of ridges, that is, the surface defined by the inner edges of the curved ridges, is likewise flattened and parallel to the outer surface. This flattening is advantageous in reducing the amount of incident light reflected from the surface of the dome in these regions.

Industrial Applicability

The particular arrangement of the curved ridges 24 of the skylight dome 10 of the invention, optimises the refractive efficiency of the ridges. This is so by virtue of the fact that the refracting facets of the ridges assume as close as possible optimum surface angles along their length commensurate with the latitude at any given point.

By the configuration of the ridges described above, the dome is able to capture a significant portion of the incident light regardless of the current sun angle, or at which point of the dome its rays are incident.

The above describes only some embodiments of the present invention and modifications, obvious to those skilled in the art, can be made thereto without departing from the scope of the present invention.

The invention claimed is:

1. A skylight dome; said dome formed of light transmitting material; at least an internal surface of said dome provided with prismatic structures arranged so as to direct incident light from outside said dome to points on a surface of a light tube extending from below a lower periphery of said dome; said prismatic structures formed as adjoining facets of a plurality of curved ridges; at least one of said facets being a refracting facet wherein a surface of said refracting facet at any point along the length of a said curved ridge forms a predetermined angle relative to an internal surface of said dome at said point; said predetermined angle varying throughout the length of said curved ridge; each of said curved ridges extending from a first upper end to a second lower end; said first upper end located on a first meridian of said dome with said second lower end located on a second meridian; said first and second meridians lying at a predetermined angular separation.

2. The dome of claim 1 wherein said first and second meridians have an angular separation of less than 180 degrees.

3. The dome of claim 1 wherein said first and second meridians have an angular separation of less than 90 degrees.

4. The dome of claim 1 wherein said predetermined angle varies from a maximum value at said first upper end of a said curved ridge to a minimum value at said second lower end of said curved ridge.

5. The dome of claim 4 wherein width of said refracting facet increases from a minimum at said first upper end of said curved ridge to a maximum at said second lower end of said curved ridge.

6. The dome of claim 1 wherein said curved ridges are formed in at least two bands of curved ridges; each of said at least two bands lying between notional circles parallel to said lower periphery of said dome.

7. The dome of claim 6 wherein said internal surface of said dome in a region bounded by an uppermost one of said notional circles is devoid of said curved ridges.

8. The dome of claim 6 wherein said internal surface of said dome in a region between said at least two bands of curved ridges is devoid of said curved ridges.

9. The dome of claim 6 wherein portions of said outer surface of said dome coincident with each of said at least two bands of curved ridges form frustum surfaces between said notional circles defining said at least two bands of curved ridges.

10. The dome of claim 1 wherein at least said outer surface of said dome is a generally hemispherical surface.

11. The dome of claim 1 wherein said dome is a component of a skylight assembly; said skylight assembly including said light tube; said light tube comprising a reflective cylindrical tube extending from below said lower periphery of said dome.

12. A method of directing incident light falling on a skylight dome towards points on a surface of a light tube extending from below a lower periphery of said dome, said method including the steps of (a) providing at least portions of an internal surface of said dome with light refracting structures, (b) arranging said light refracting structures as curved ridges extending from a first upper end to a second lower end and between a first meridian of said dome at said first upper end and a second meridian of said dome at said second lower end, and wherein said first upper end and said second lower end lie at a predetermined angular separation.

13. The method of claim 12 wherein each of said curved ridges is formed as adjacent facets; at least one of said adjacent facets acting as a refracting facet.

14. The method of claim 12 wherein said method further includes the step of arranging said curved ridges in at least two bands of curved ridges; said bands of curved ridges lying between notional circles parallel to said lower periphery of said dome.

15. The method of claim 12 wherein at least a first region proximate the apex of said dome is devoid of said curved ridges.

16. The method of claim 15 wherein said predetermined angular separation is less than 180 degrees.

17. The method of claim 15 wherein said predetermined angular separation is less than 90 degrees.

18. The method of claim 12 wherein at least portions of said incident light refracted by said refracting facets are incident on a wall of said light tube; said light tube comprising a reflective cylindrical tube extending from below said lower periphery of said dome.

* * * * *